US006957973B1

(12) United States Patent
McHugh et al.

(10) Patent No.: US 6,957,973 B1
(45) Date of Patent: Oct. 25, 2005

(54) LAND GRID ARRAY CONNECTOR AND METHOD OF ASSEMBLING AN IC CHIP THEREIN

(75) Inventors: Robert G. McHugh, Golden, CO (US); Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/055,412

(22) Filed: Feb. 9, 2005

(51) Int. Cl.[7] ..... H01R 13/62
(52) U.S. Cl. ..... 439/331; 439/73
(58) Field of Search ..... 439/311, 342, 330, 439/72, 71, 73, 525, 526, 264

(56) References Cited

U.S. PATENT DOCUMENTS

| | | | | |
|---|---|---|---|---|
| 5,688,140 | A | 11/1997 | McHugh et al. | |
| 6,692,279 | B1 * | 2/2004 | Ma | 439/331 |
| 6,716,050 | B1 * | 4/2004 | Ma et al. | 439/331 |
| 6,758,691 | B1 * | 7/2004 | McHugh et al. | 439/331 |
| 6,776,625 | B2 * | 8/2004 | Ma | 439/73 |
| 6,776,642 | B1 * | 8/2004 | McHugh et al. | 439/331 |
| 6,780,024 | B2 * | 8/2004 | Ma | 439/73 |
| 6,780,025 | B2 * | 8/2004 | Ma et al. | 439/73 |
| 6,780,041 | B1 * | 8/2004 | Ma | 439/342 |
| 6,799,978 | B2 * | 10/2004 | Ma et al. | 439/73 |
| 6,827,589 | B2 * | 12/2004 | Lin et al. | 439/76.1 |
| 6,848,929 | B2 * | 2/2005 | Ma | 439/331 |
| 6,869,303 | B1 * | 3/2005 | Ma | 439/331 |
| 6,875,038 | B1 * | 4/2005 | McHugh et al. | 439/331 |
| 2004/0067672 | A1 * | 4/2004 | Ma | 439/331 |
| 2004/0095693 | A1 | 5/2004 | Shirai et al. | |
| 2004/0097119 | A1 * | 5/2004 | Ma | 439/331 |
| 2004/0229492 | A1 * | 11/2004 | Ma | 439/331 |
| 2004/0266245 | A1 * | 12/2004 | Liao | 439/331 |
| 2005/0014400 | A1 * | 1/2005 | Liao et al. | 439/73 |
| 2005/0014401 | A1 * | 1/2005 | Ma et al. | 439/135 |
| 2005/0014411 | A1 * | 1/2005 | Ma | 439/331 |
| 2005/0020117 | A1 * | 1/2005 | Motohashi | 439/331 |
| 2005/0026490 | A1 * | 2/2005 | Ma | 439/331 |
| 2005/0032408 | A1 * | 2/2005 | Liao et al. | 439/331 |
| 2005/0042897 | A1 * | 2/2005 | Zhang et al. | 439/71 |
| 2005/0064753 | A1 * | 3/2005 | Ma | 439/331 |

* cited by examiner

*Primary Examiner*—P. Austin Bradley
*Assistant Examiner*—Phuongchi Nguyen
(74) *Attorney, Agent, or Firm*—Wei Te Chung

(57) ABSTRACT

A land array grid (LGA) connector and a method for assembling an IC chip into the LGA connector is provided. The LGA connector comprises an insulative housing (1) having a plurality of electrical terminals (2) received therein, a reinforcement plate (3) surrounding the insulative housing, a load plate (4) and a lever (5) pivotally connected to a same end of the reinforcement plate. The load plate and the lever rotate with respect to the reinforcement plate between an open position and a closed position; and the lever pushes the load plate to move from a middle position to the closed position during the lever rotates from the opening position to the closed position such that a free end of the load plate engages with the reinforcement plate.

20 Claims, 7 Drawing Sheets

LAND GRID ARRAY CONNECTOR AND METHOD OF ASSEMBLING AN IC CHIP THEREIN

BACKGROUND OF THE INVENTION

1. Field of the Invention

The present invention relates to the field of electrical connectors, and more particularly to a land grid array (LGA) connector having a locking mechanism for securely locking an IC chip in the LGA connector and method for assembling the IC chip into the LGA connector.

2. Background of the Invention

Electrical connectors are widely used in the electronic transmitting field to interconnect two separate electronic, components, i.e. an IC chip and a motherboard, so as to establish electrical connection therebetween. The electrical connector basically comprises an insulative housing and a plurality of electrical terminals received in the housing, where one kind of land grid array (LGA) type terminals are commonly used in recent years to interconnect the electronic components, especially to interconnect a LGA type IC chip with a LGA type connector. Commonly, when the LGA type IC chip is mounted onto an insulative housing of the LGA type connector, electronic pads of the IC chip all resist the LGA type terminals in the housing of the LGA type connector thereby establishing the electrical connection. However, the IC chip is easy to move with respect to the terminals since there is not any extra maintaining force existed between the pads and the terminals. Therefore, it is necessary to develop an extra locking mechanism to firmly locate the IC chip in the connector so as to ensure stably electrical connection.

One conventional locking mechanism is disclosed in U.S. Pat. No. 5,387,120. The locking mechanism comprises a cover pivotally connected to one end of a main body and a latch movably attached to a free end of the cover. Rotation of the cover to an open position allows an IC chip to be mounted into the main body, and then the cover rotates to a closed position to sandwich the IC chip between the over and the main body, and finally the latch rotates and engages with the other end of the main body to secure the cover to the main body so as to firmly retain the IC chip in the main body. However, the whole structure of the locking mechanism, especially the structures of the cover and the latch, is so complicated that it costs too much money to manufacture and that it is difficult to assemble. This kind of locking mechanism may be not suitable for popular use.

Another conventional locking mechanism is disclosed in US Patent Publication No. 2004/0095693A1. The locking mechanism disclosed in the patent application comprises a load plate pivotally connected to one end of a reinforcement plate and a lever pivotally connected to the other opposite end of the reinforcement plate. After the IC chip is mounted onto an insulative housing in the reinforcement plate, the load plate and the lever all rotate from their open position to their closed position, and the lever presses onto a free end of the load in the closed position thereby apply a pressing force to the load plate for securing the IC chip between the load plate and the housing. The structure of this kind of locking mechanism is relatively simple and easy to manufacture and assemble. However, when the LGA connector is mounted onto a motherboard, it may need a relatively large room to be reserved on the motherboard in order to ensure full rotation of the load plate and the lever between the open and the closed positions. Especially, the space outside the opposite ends of the reinforcement plate all has to be reserved, which is not desirable during design of the motherboard layout.

Accordingly, what is needed is to provide an land grid array (LGA) connector having an improved locking mechanism, wherein the locking mechanism is easy to make and assemble, and can ensure a stable locating of an IC chip in the connector as well.

Consequently, what is also needed is to provide a new method of assembling an IC chip into a land array grid (LGA) connector and securing the IC chip in the LGA connector by the improved locking mechanism.

SUMMARY OF THE INVENTION

An land array grid (LGA) connector in accordance with a preferred embodiment of the present invention comprises an insulative housing having a plurality of electrical terminals received therein, a reinforcement plate surrounding the insulative housing, a load plate and a lever pivotally connected to a same end of the reinforcement plate. The load plate and the lever rotate with respect to the reinforcement plate between an open position and a closed position; and the lever pushes the load plate to move during the lever rotates from the opening position to the closed position such that a free end of the load plate engages with the reinforcement plate thereby sandwiching an IC chip between the load plate and the insulative housing. Preferably, before the lever pushes the load plate to move, the load plate has rotated from the open position to a middle position where the load plate contacts with the IC chip but the free end of the load plate does not engage with the reinforcement plate.

A method for assembling an IC chip into the LGA connector of the preferred embodiment may comprise four main steps. Firstly, the load plate and the lever of the LGA connector are rotated to the open position. Secondly, the IC chip is mounted onto the housing of the LGA connector. Thirdly, the load plate is rotated with respect to the reinforcement plate from the open position to a middle position such that the load pate is located onto the IC chip. Finally, the lever is rotated from the opening position to the closed position and simultaneously pushes the load plate to move with respect to the reinforcement plate from the middle position to the closed position.

DETAILED DESCRIPTION OF PREFERRED EMBODIMENTS

Reference will now be made to the drawings to describe a preferred embodiment of the present invention in detail.

Figure 1:
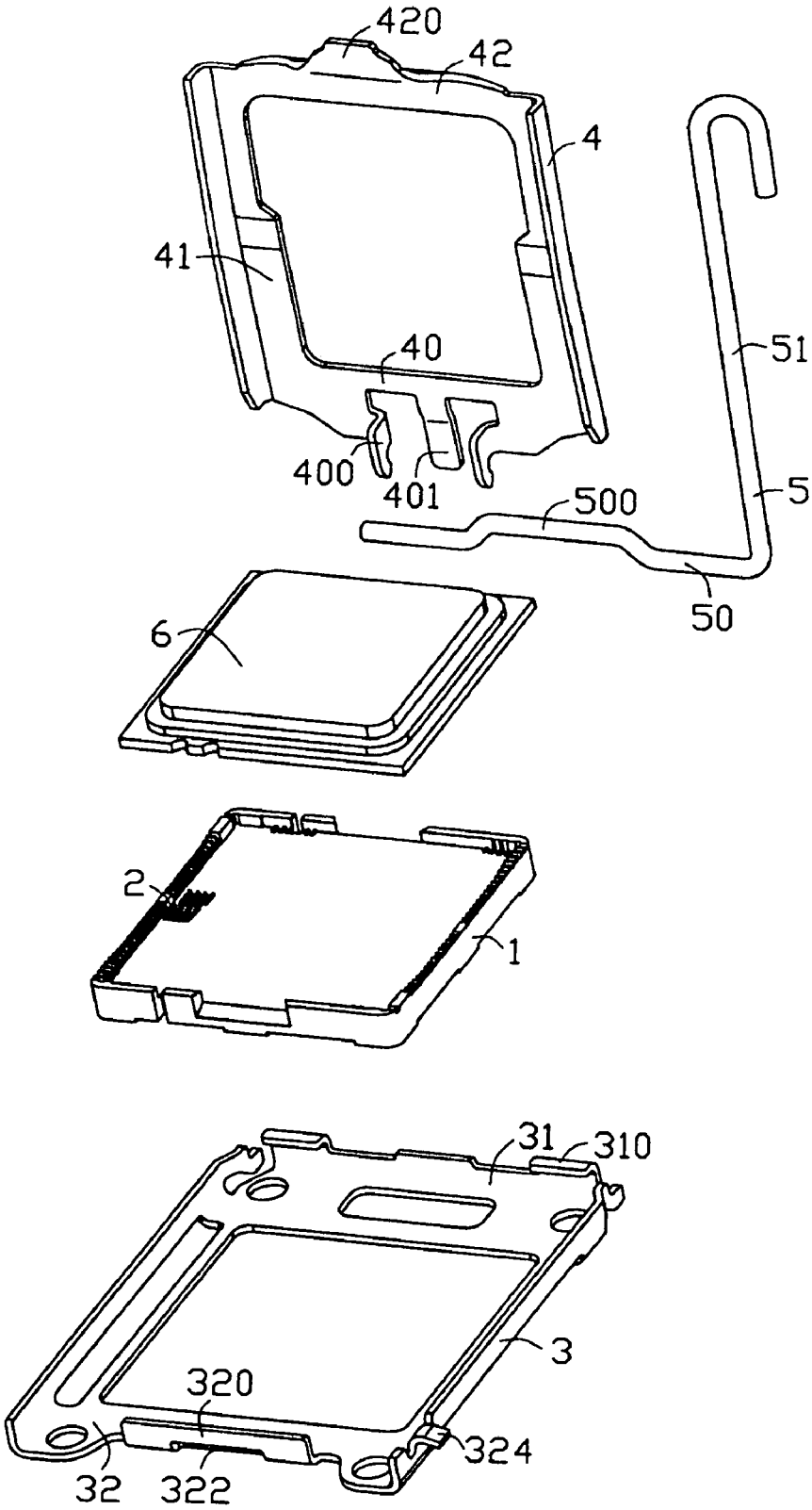
FIG. 1 is an exploded view of a land grid array (LGA) connector in accordance with a preferred embodiment of the present invention, and an IC chip.

Referring to FIG. 1, a land array grid (LGA) connector in accordance with a preferred embodiment of the present invention comprises an insulative housing 1 having a plurality of electrical terminal 2 received therein, a reinforcement plate 3 adapted to be attached to periphery of the insulative housing 1, a load plate 4 adapted to be pivotally connected to one end of the reinforcement plate 3, and a lever 5 adapted to driving movement of the load plate 4 with respect to the reinforcement plate 3. The insulative housing 1 forms an inner space in an upper surface thereof for accommodating an IC chip 6 therein When the LGA connector is mounted onto a motherboard (not shown in the FIGS.), the terminals 2 in the housing 1 electrically interconnect the IC chip 6 to the motherboard such that signal transmission between the IC chip 6 and the motherboard is established via the LGA connector.

In the preferred embodiment, the reinforcement plate 3 is made of metallic material i.e. stainless iron, so as to strengthen the insulative housing 1 to prevent it from becoming crashed under an undesired outer force. Understandably, the reinforcement plate 3 can also be made from other materials if only the materials are rigid enough to strengthen the housing 3. The reinforcement plate 3 is attached to the periphery of the housing 1 and substantially positioned onto a bottom surface of the housing 1, which comprises a first end 31 and a second end 32 opposite to the first end 31. The first end 31 has a pair of spaced first latches 310 extending upwardly therefrom and bending inwardly at a free end thereof, and the second end 32 has a second latch 320 extend upwardly therefrom. The second latch 320 forms a slot 322, function of which will be described later in detail. The load plate 4 comprises a connecting portion 40, an engaging portion 42 opposite to the connecting portion 40, and a pair of pressing portion 41 interconnecting the connecting portion 40 and the engaging portion 42. The connecting portion 40, the engaging portion 42 and the pressing portions 41 surround a central opening. A pair of latches 400 is formed on the connecting portion 40 and a locating end 401 is formed between the two latches 400. A tongue 420 is formed at a free end of the engaging portion 42. The lever 5 comprises an actuation portion 50 and a driving portion 51 vertically bending from the actuation portion 50. The actuation portion 50 has a pushing portion 500 formed at a middle part thereof.

Figure 2:
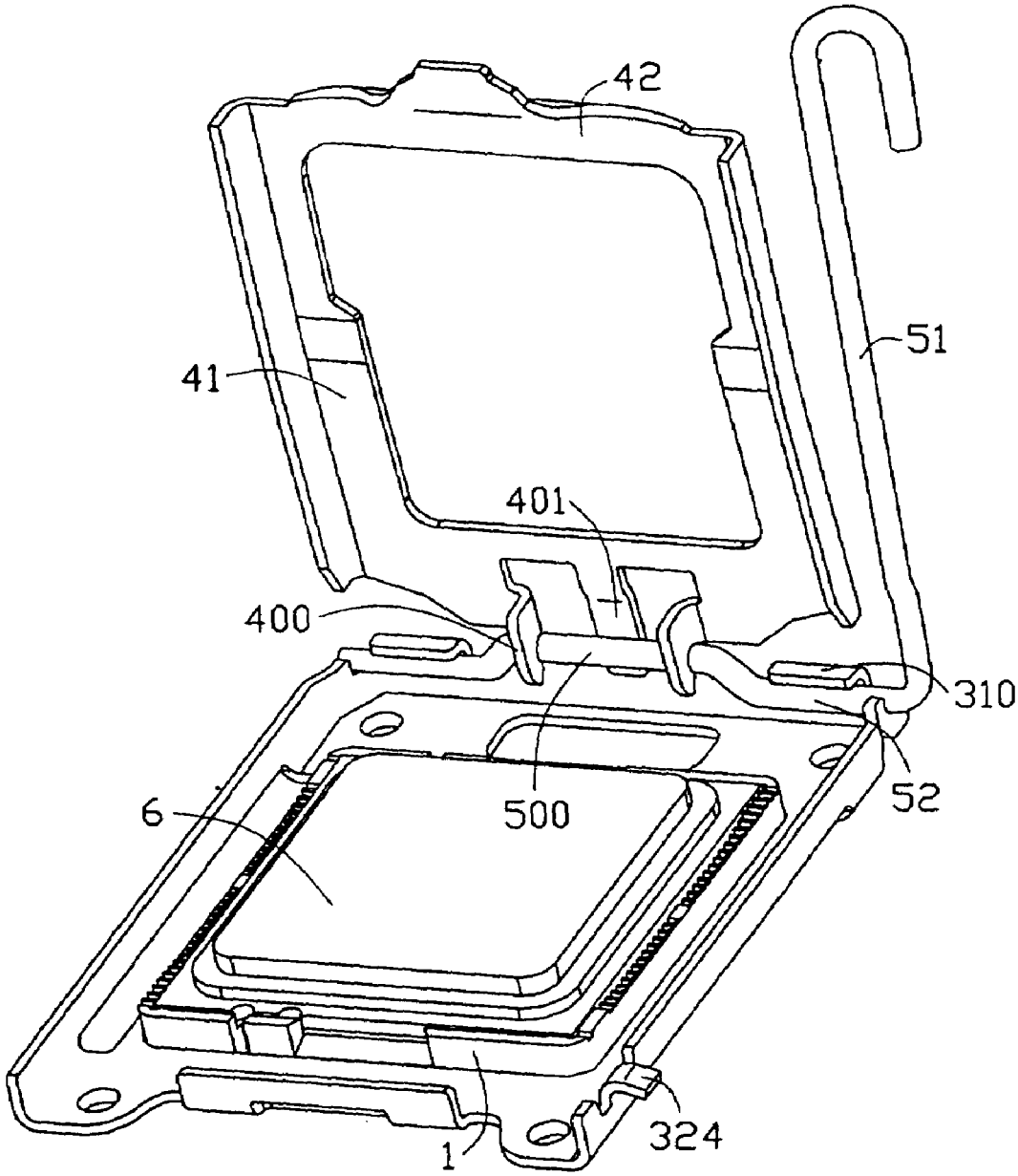
FIG. 2 is an assembled view of the LGA connector of FIG. 1 and the IC chip, a load plate and a lever of the connector being all at an open position.
Figure 3:
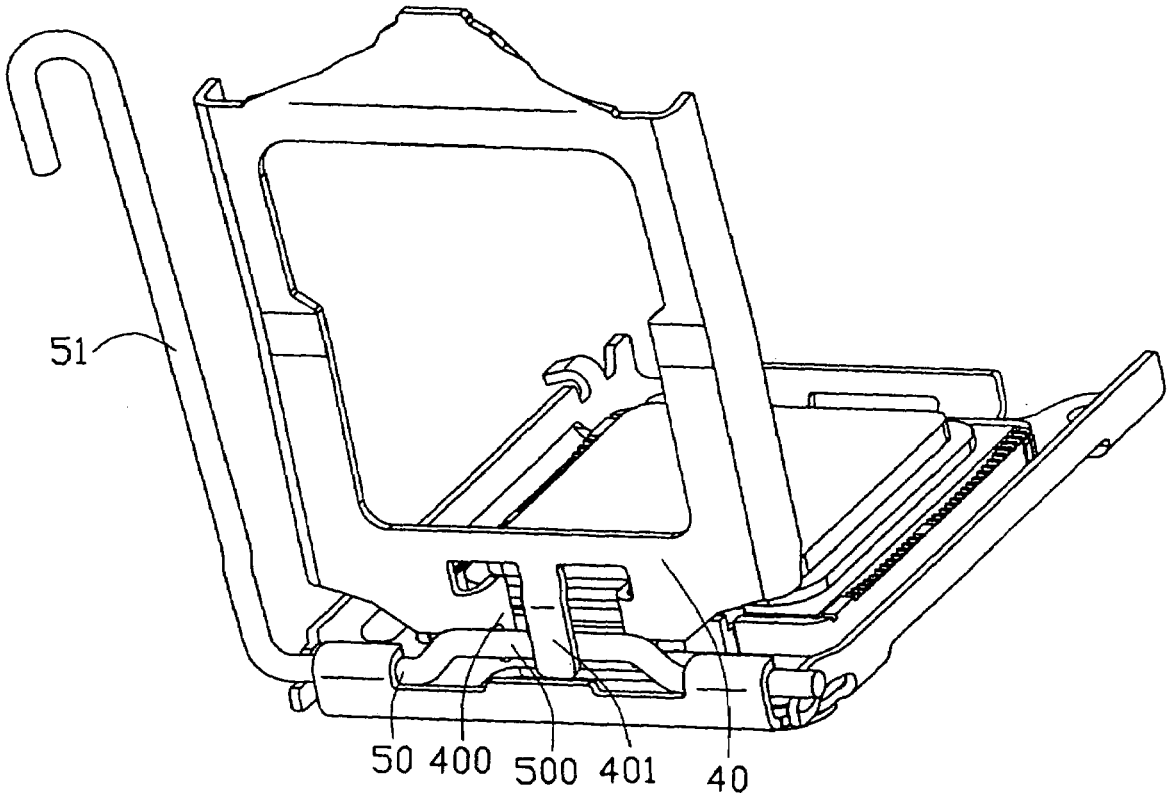
FIG. 3 is similar to FIG. 2, and seeing from an opposite angel of view.

Referring to FIGS. 2 and 3, an open state of the LGA connector of the preferred embodiment is illustrated. The insulative housing 1 is positioned into an inner side of the reinforcement plate 3 and located between the first end 31 and the second 32 of the reinforcement plate 3. The IC chip 6 is positioned onto a top surface of the housing 1 and located into the inner space of the housing 1. The lever 5 is pivotally connected to the first end 31 of the reinforcement plate 2, with the actuation portion 50 of the lever 5 being connected with the first latches 310 on the first end 31 and the pushing portion 500 being located between the pair of first latches 310. The driving portion 51 of the lever 5 is located at an open position where the driving portion 51 is perpendicular to the insulative housing 1 and the reinforcement plate 3. The load plate 4 is pivotally connected to the actuation portion 50 of the lever 5, with the pair of latches 400 on the connecting portion 40 being connected to one side of the pushing portion 500 of the actuation portion 50 and the locating end 401 on the connecting portion 40 contacting with the other opposite side of the pushing portion 500 of the actuation portion 50. The load plate 4 is located at an open position where the pressing portions 41 are perpendicular to the insulative housing 1 and the reinforcement plate 3 to allow mounting of the IC chip 6 into the inner space of the insulative housing 1.

Figure 4:
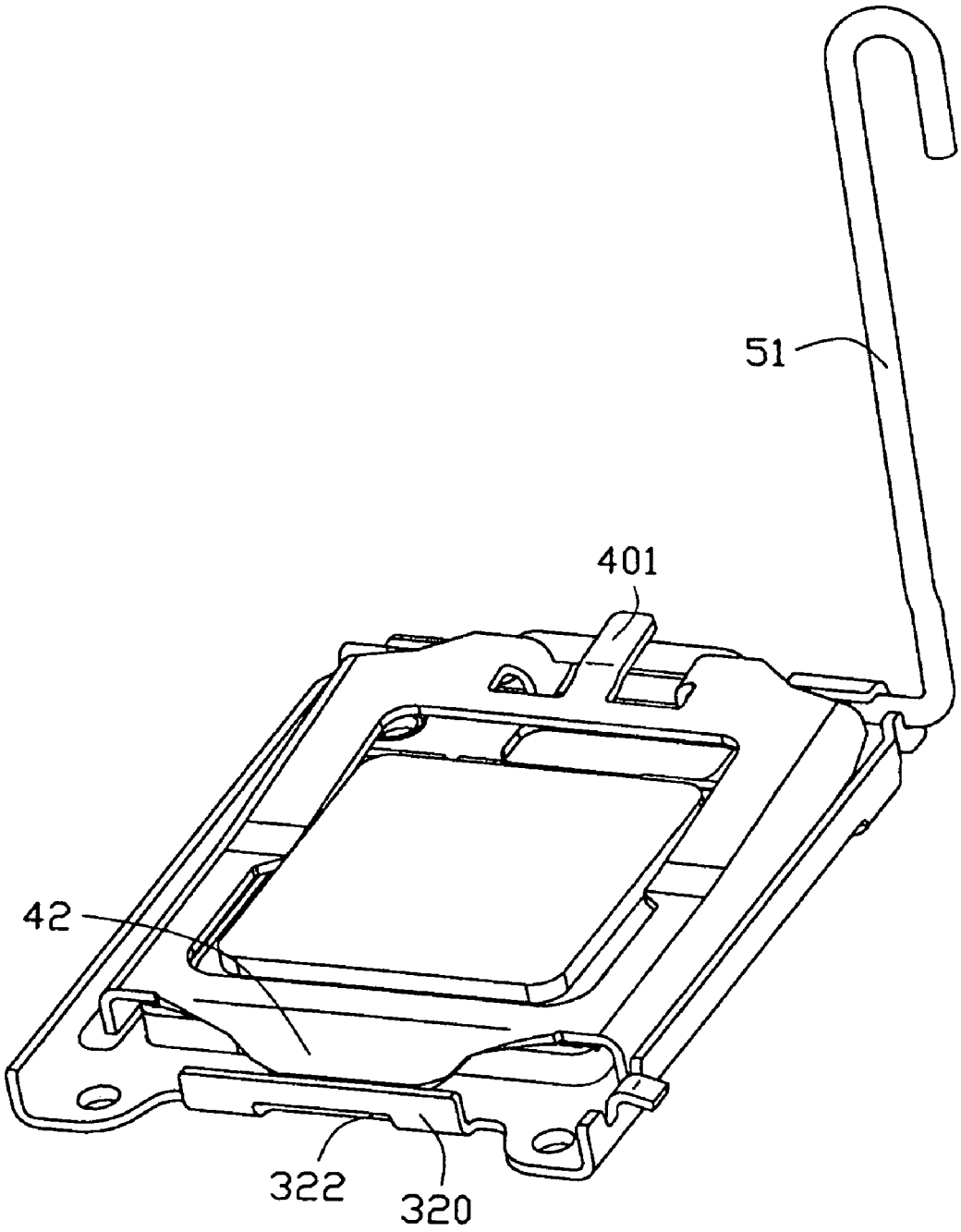
FIG. 4 is an assembled view of the LGA connector of FIG. 1 and the IC chip, a load plate of the connector being at a middle position and a lever of the connector being at the open position.
Figure 5:
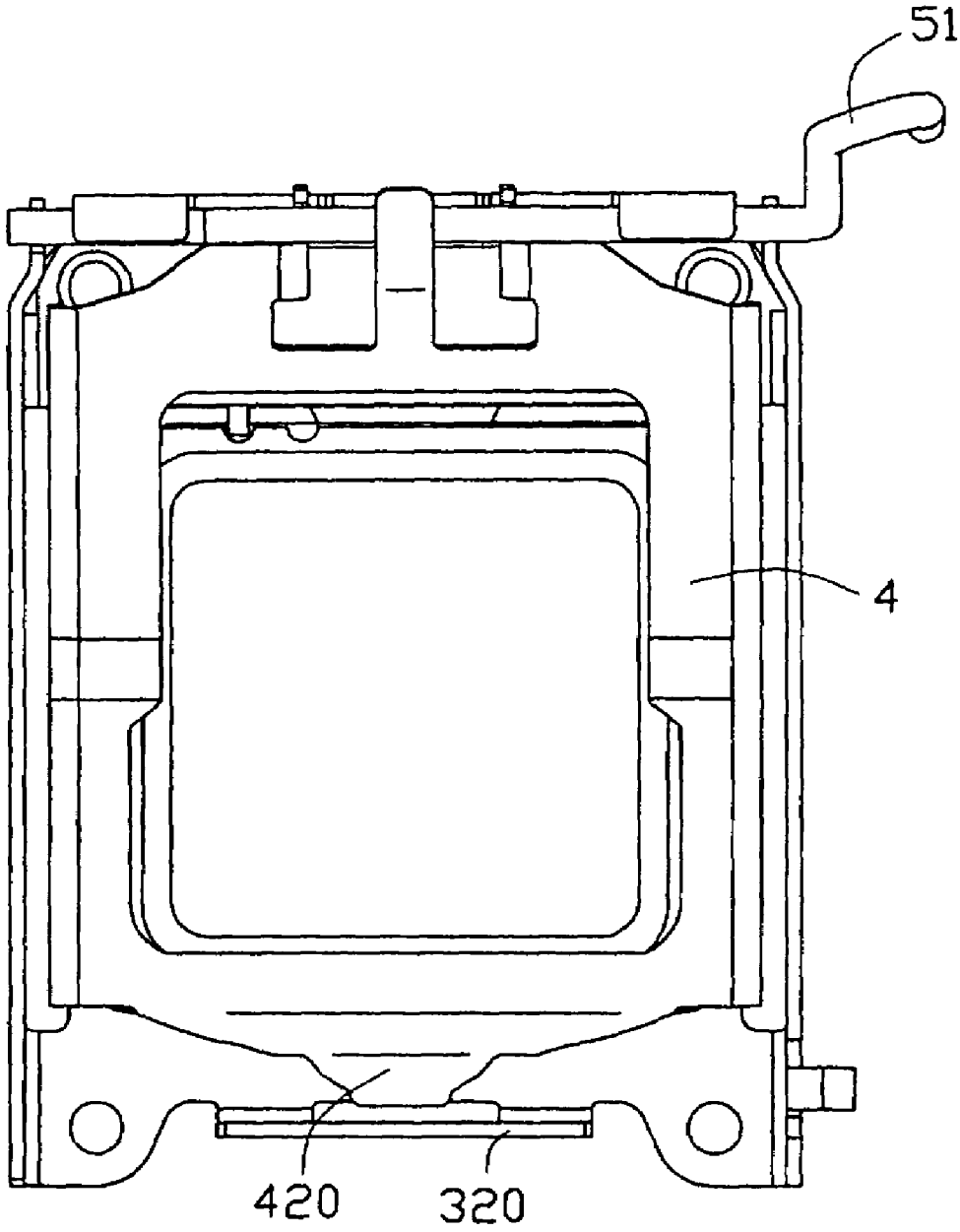
FIG. 5 is a top view of the LGA connector of FIG. 4.

Referring to FIGS. 4 and 5, because of the cooperatively locating function of the latches 400 and the locating end 401, the load plate 4 is movably connected to the pushing portion 500 of the lever 5 and can rotate with respect to the insulative housing 1 and the reinforcement plate 3. In FIGS. 4 and 5, the load plate 4 has rotated from the open position to a middle position while the lever 5 is still kept at the open position. At the middle position, the pressing portion 41 of the load plate 4 is positioned onto a top surface of the IC chip 6, and the engaging portion 42 of the load plate 4 is positioned near the second end 32 of the reinforcement plate 3, but the tongue 420 of the engaging portion 42 does not contact with the second latch 320 on the second end 32, i.e., the engaging portion 42 of the load plate 4 is free and the pressing portions 41 do not apply a pressing force to the IC chip 6.

Figure 6:
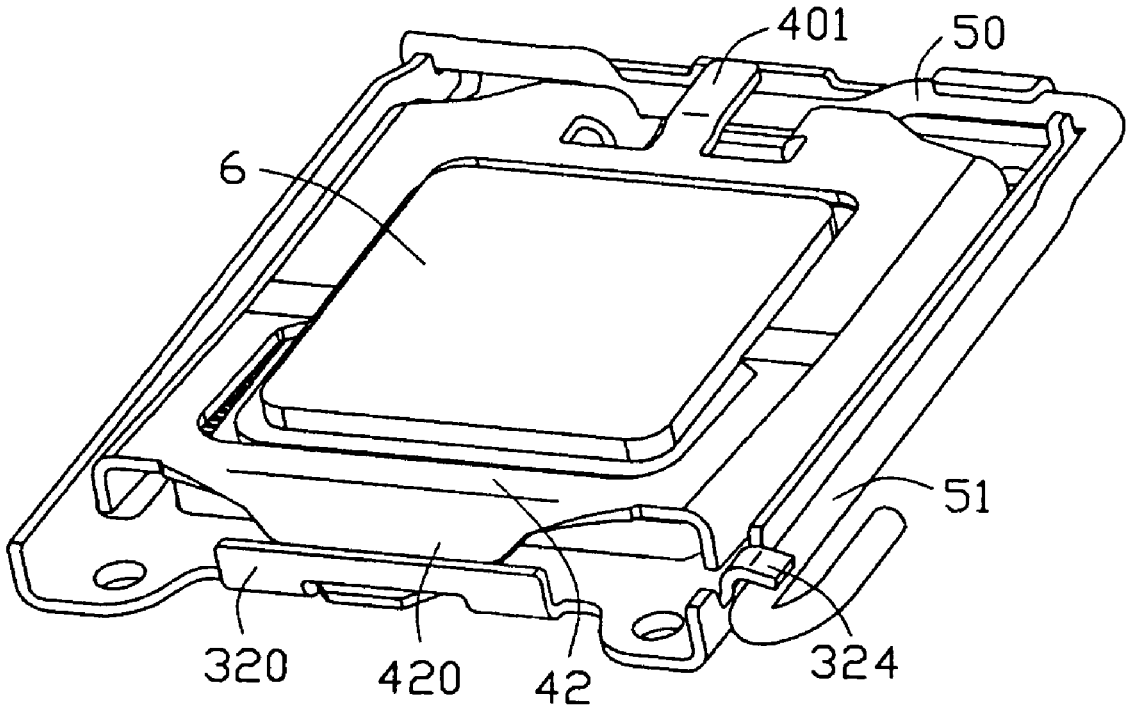
FIG. 6 is an assembled view of the LGA connector of FIG. 1 and the IC chip, a load plate and a lever of the connector being all at the closed position.
Figure 7:
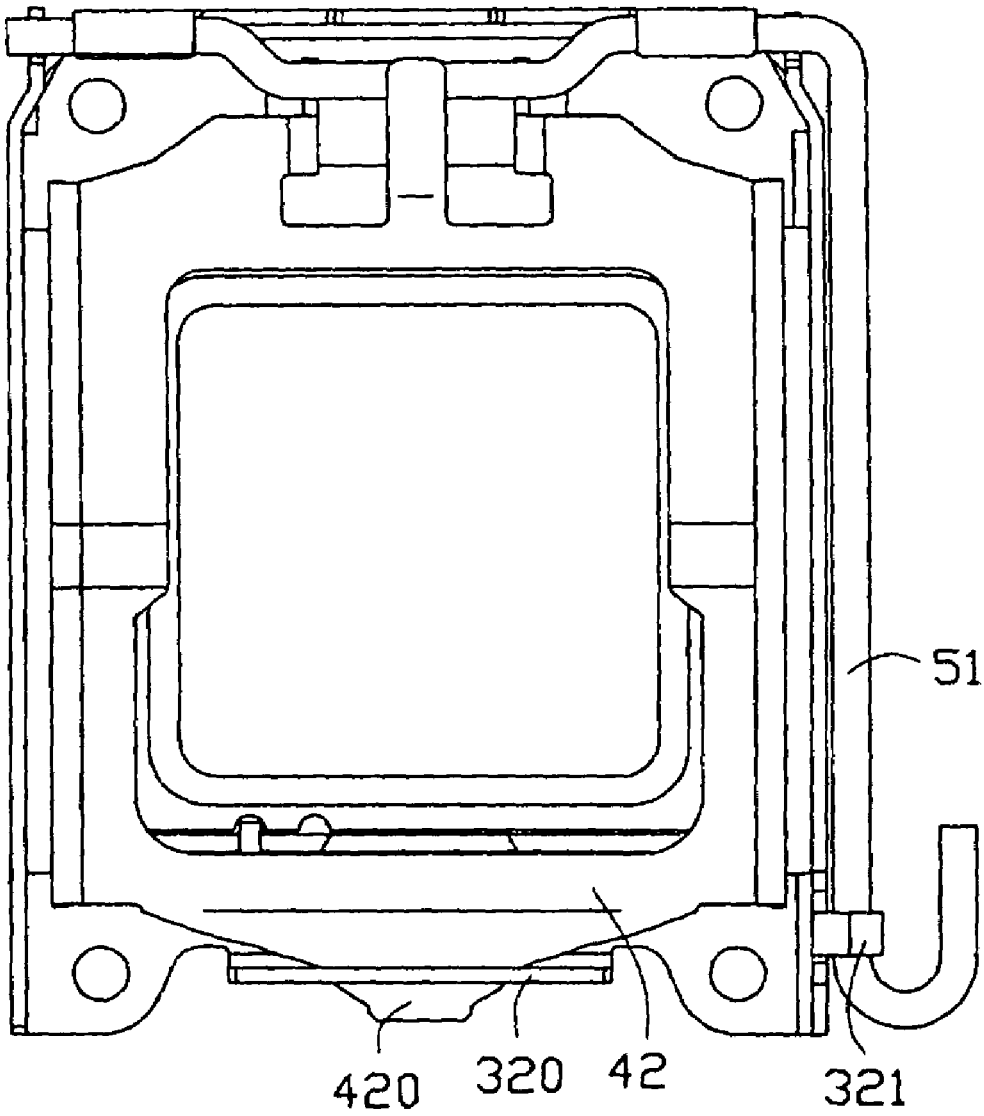
FIG. 7 is a top view of the LGA connector of FIG. 6.

Referring to FIGS. 6 and 7, a closed state of the LGA connector is illustrated. The lever 5 has rotated from the open position to a closed position with the driving portion 51 of the lever 5 being locked by a third latch 324 formed at one end of the second end 32. During rotation of the lever 5 from the open position to the closed position, the pushing portion 500 of the lever 5 pushes the load plate 4 to move with respect to the insulative housing 1 and the reinforcement plate 3 along a horizontal direction by applying a pushing force to the latches 400 of the load plate 4, such that the tongue 420 inserts into the slot 322 of the second latch 320. Thus, the engaging portion 42 of the load plate is locked by the second latches 320 of the reinforcement plate 3 so as to secure the IC chip 6 between the load plate 4 and the insulative housing 1.

Accordingly, a method for assembling the IC chip 6 into the LGA connector of the preferred embodiment may include the following main steps:

(a) Rotating the load plate 4 and the lever 5 to their open positions such that the LGA connector is kept at its open state;

(b) Mounting the IC chip 6 onto the insulative housing 1 of the LGA connector, and locating the IC chip 6 into the inner space defined by the insulative housing 1;

(c) Rotating the load plate 4 from the open position to the middle position and allowing the pressing portions 41 of the load plate 4 to contact with a top surface of the IC chip 6, and keeping the lever 5 at its open position;

(d) Rotating the lever 5 from its open position to its closed position and simultaneously pushing the load plate to move with respect to the reinforcement plate 4 in a horizontal direction such that the tongue 420 of the load plate 4 inserts into the slot 322 of the second latch 320 of the reinforcement plate 3, and the lever 5 is kept at its closed position by the third latch 324 formed at the second end 32 of the reinforcement plate 3.

Preferably, a downwardly outer pressing force, i.e., a pressing force from an operator's fingers during assembling of the IC chip into the LGA connector, is often applied to the load plate 4 during movement of the tongue 420 of the load plate 4 toward the slot 322 in aid of insertion of the tongue 420 into the slot 322.

It is to be understood that the load plate 4 of the LGA connector in the preferred embodiment is pivotally connected to the actuation portion 50 of the lever 5, while the load plate 5 can also be movably connected to other elements of the LGA connector, i.e., the load plate 4 being able to be pivotally connected to the first end 31 of the reinforcement plate 3 in an alternative embodiment or pivotally connected to the insulative housing 2 in another alternative embodiment, as long as the load plate 4 and the lever 5 are located at a substantially same side of the LGA connector and the load plate 5 can be pushed to move from the middle position to the closed position.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing having a plurality of electrical terminals received therein;

a reinforcement plate attached to the insulative housing;

a load plate and a lever pivotally connected to a same end of the reinforcement plate, the load plate and the lever rotating with respect to the reinforcement plate between an open position and a closed position; and wherein the lever pushes the load plate to move as the lever rotates from the opening position to the closed position such that a free end of the load plate engages with the reinforcement plate.

2. The electrical connector of claim 1, wherein the reinforcement plate comprises a first end and an opposite second end, the insulative housing being located between the first end and the second end, and the load plate and the lever are all pivotally connected to the first end.

3. The electrical connector of claim 2, wherein the lever comprises an actuating portion and a driving portion vertically bend from the actuating portion, the actuating portion being movably secured to the first end of the reinforcement plate and forming a pushing portion in a middle part thereof.

4. The electrical connector of claim 3, wherein the load plate comprises an engaging portion formed at the free end thereof and a connecting portion formed at the other end opposite the free end, the connecting portion movably connecting to the actuating portion of the lever.

5. The electrical connector of claim 4, wherein the engaging portion comprises a tongue extending therefrom and engaging with a slot formed in the second end of the reinforcement plate.

6. The electrical connector of claim 4, wherein the connecting portion comprises a pair of latches and a locating end, the latches and the end corporately and movably connecting the load plate to the pushing portion of the lever.

7. An electrical connector adapted to electrically connecting with an IC chip, the connector comprising:

an insulative housing having a plurality of electrical terminals received therein;

a reinforcement plate associated with the periphery of the insulative housing;

a load plate rotating with respect to the reinforcement plate between an open position, where the IC chip can be mounted to the housing, and a middle position, and moving with respect to the reinforcement plate from the middle position to a closed position where the IC chip are located to the housing;

a lever movably connected to the reinforcement plate and moveable with respect to the reinforcement plate between an open location and a closed location; and pushing the load plate to move from the middle position to the closed position during movement of the lever from the open location to the closed location.

8. The electrical connector of claim 7, wherein said lever is rotatable with regard to the reinforcement plate between the opening location and the closed location.

9. The electrical connector of claim 8, wherein the load plate is generally horizontally moved during movement from the middle position to the closed position.

10. The electrical connector of claim 8, wherein the reinforcement plate comprises a first end and an opposite second end, the load plate and the lever pivotally rotating with respect to the first end.

11. The electrical connector of claim 10, wherein the load plate and the lever all directly connected to the first end of the reinforcement plate and rotate with respect to the reinforcement plate.

12. The electrical connector of claim 10, wherein the lever comprises an actuating portion connecting to the first end of the reinforcement plate and a driving portion bending from the actuating portion.

13. The electrical connector of claim 12, wherein one end of the load plate pivotally connected to the actuating portion of the lever, and the other opposite end of the load plate engages with the second end of the reinforcement plate when the load plate is at the closed position.

14. The electrical connector of claim 13, wherein the actuating portion of the lever comprises a pushing portion which connects with a pair of latches formed on the load plate, and the load plate is pushed to move from the middle position to the closed position by the pushing portion.

15. The electrical connector of claim 13, wherein a slot is formed in the second end of the reinforcement plate, the slot engaging with a tongue formed at a free end of the load plate.

16. A method of assembling an IC chip into an electrical connector, the method comprising the steps:

providing an insulative housing having a plurality of electrical terminals received therein;

providing a reinforcement plate, a load plate and a lever;

attaching the reinforcement plate to the insulative housing;

locating the load plate and the lever on the reinforcement plate at an open position;

mounting the IC chip to the housing;

rotating the load plate from the open position to a middle position;

rotating the lever from the opening position to a closed position and thereby simultaneously pushing the load plate to move with respect to the reinforcement plate from the middle position to the closed position.

17. The method of claim 16, further comprising the step of engaging a tongue portion formed at a free end of the load with a slot formed at a second end of the reinforcement plate.

18. The method of claim 16, further comprising the step of pivotally connecting the load plate and the lever to a same end of the reinforcement plate.

19. The method of claim 16, further comprising the step of connecting an actuating portion of the lever to a first end of the reinforcement plate.

20. The method of claim 19, further comprising the step of pivotally connecting the load plate to the actuating portion of the lever.

* * * * *